US007641305B2

(12) United States Patent
Mano et al.

(10) Patent No.: US 7,641,305 B2
(45) **Date of Patent: *Jan. 5, 2010**

(54) LIQUID EJECTING APPARATUS

(75) Inventors: Takashi Mano, Nagano-ken (JP); Shozo Kuwada, Nagano-ken (JP); Nobuhito Takahashi, Nagano-ken (JP); Hitoshi Hayakawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 239 days.

This patent is subject to a terminal disclaimer.

(21) Appl. No.: 11/808,833

(22) Filed: Jun. 13, 2007

(65) Prior Publication Data

US 2007/0236532 A1 Oct. 11, 2007

Related U.S. Application Data

(63) Continuation of application No. 10/953,108, filed on Sep. 30, 2004, now Pat. No. 7,244,013.

(30) Foreign Application Priority Data

Oct. 1, 2003 (JP) ..... 2003-342862
Aug. 19, 2004 (JP) ..... 2004-239842

(51) Int. Cl.
*B41J 2/165* (2006.01)

(52) U.S. Cl. ..... 347/29; 347/32

(58) Field of Classification Search ..... 347/29, 347/30, 33, 32, 24
See application file for complete search history.

(56) References Cited

U.S. PATENT DOCUMENTS 5,504,508 A 4/1996 Hashimoto

FOREIGN PATENT DOCUMENTS

| | | | |
|---|---|---|---|
| JP | 7-52406 | A | 2/1995 |
| JP | 10-181040 | A | 7/1998 |
| JP | 2000-225715 | A | 8/2000 |

*Primary Examiner*—Shih-Wen Hsieh
(74) *Attorney, Agent, or Firm*—Sughrue Mion, PLLC

(57) ABSTRACT

A printer includes a cleaning mechanism that reliably performs an operation of cleaning a liquid ejecting head with a small amount of driving energy. The cleaning mechanism includes a cap manufactured by coinjection molding of a core part and an elastic part. The cap includes a bottom surface, an outer wall, and a partition wall dividing a cap inner space surrounded by the outer wall into two. A ratio of the elastic part in the partition wall is higher than that in the outer wall. With this structure, the partition wall is more elastically deformable than the outer wall. When the cap comes into contact with a nozzle surface of a recording head and covers nozzle rows, the outer wall comes into contact with the nozzle surface with a larger stress compared with the partition wall, and seals chambers where the nozzle rows on the nozzle surface are exposed.

3 Claims, 9 Drawing Sheets

LIQUID EJECTING APPARATUS

CROSS-REFERENCE TO RELATED APPLICATIONS

This application is a continuation of U.S. patent application Ser. No. 10/953,108 filed on Sep. 30, 2004 now U.S. Pat. No. 7,244,013 which is based upon and claims the benefit of priority from prior Japanese Patent Application Nos. 2003-342862, filed on Oct. 1, 2003, and 2004-239842, filed on Aug. 19, 2004, the entire contents of which are incorporated herein by reference.

BACKGROUND OF THE INVENTION

The present invention relates to a liquid ejecting apparatus.

A printer that prints by ejecting ink droplets from a recording head toward a recording medium is known as a liquid ejecting apparatus for ejecting a liquid onto a target. In conventional printers, solvents of ink may vaporize within a recording head and the vaporized solvents may diffuse from nozzles of the recording head. If this happens, viscosity of the ink in the recording head increases. The increased ink viscosity may clog the nozzles, or may cause dust to adhere to the nozzles. Also, air bubbles may enter from the nozzles into the recording head when the ink cartridge is replaced. Such entry of air bubbles and clogging of the nozzles may cause printing failures.

To prevent printing failures, conventional printers perform a cleaning operation for aspirating ink out of nozzles of the recording head. By aspirating ink out of the nozzles, such nozzle problems as clogging, adhesion of dust, and entry of air bubbles are prevented.

The following describes the cleaning operation in detail. A cleaning mechanism arranged in a printer typically performs the cleaning operation. The cleaning mechanism includes a cap for covering nozzles of a recording head, an ink drain path that is connected to the cap, and a depressurizing pump arranged midway on the ink drain path. The cap is placed to cover the nozzles of the recording head, and the depressurizing pump is driven, so that the inner pressure of the cap is decreased. This causes ink to be aspirated out of the nozzles of the recording head. The aspirated ink is drained via the ink drain path. With this operation, clogging of the nozzles is prevented.

A conventional printer for color printing uses inks of plural colors, e.g., Cyan, Magenta, Yellow, and Black. The printer using inks of plural colors has, on its recording head, nozzle rows whose number corresponds to the number of the colors. Such a printer may perform the cleaning operation by covering all the nozzle rows on the recording head with a cap, and aspirating ink out of all the nozzle rows at the same time.

With this cleaning operation, however, ink is aspirated even from nozzles that are not clogged. As a result, excess ink is consumed. To reduce such wasting of ink, Japanese Laid-Open Patent Publication No. 2000-225715 proposes a cleaning mechanism that selectively aspirates ink only from nozzle rows that require cleaning.

In detail, a cap of this cleaning mechanism has a plurality of chambers. A plurality of ink drain paths in one-to-one correspondence with the chambers are arranged between the chambers and a depressurizing pump. Each ink drain path has a valve. During the cleaning operation, a valve on each ink drain path is adjusted to open and close according to the clog state of the corresponding nozzle row. Among the plurality of chambers of the cap, only a chamber connected to an ink drain path whose valve is open is depressurized. Ink is aspirated out of the nozzle row corresponding to the depressurized chamber. In this way, this cleaning mechanism aspirates ink only from nozzle rows that require removal of clogging, so that wasting of ink is reduced.

To improve color reproduction and gloss of a printed image, a printer that ejects reactive ink from its recording head in addition to normal color ink is conventionally known. The reactive ink includes clear (colorless) ink. The reactive ink coagulates with color ink on a recording medium, to improve color reproduction and gloss of a printed image.

When the printer that uses reactive ink performs the cleaning operation, color ink and reactive ink may react and coagulate within a cap. This may degrade the function of the cleaning mechanism. To prevent such a coagulating reaction of color ink and reactive ink within the cap and prevent degradation of the cleaning mechanism function, this printer may also employ the above-described cap, which has a plurality of chambers.

The above-described cap has its case unit being divided into a plurality of chambers by a partition wall. During the cleaning operation, an upper edge of the case unit and an upper edge of the partition wall simultaneously come into contact with the nozzle surface of the recording head.

When this cap is brought into contact with the nozzle surface, however, the upper edge of the case unit and/or the upper edge of the partition wall may be stress-deformed under a load, which is caused by a spring pressing the cap. For example, the upper edge of the partition wall may come in close contact with the nozzle surface, whereas the upper edge of the case unit may not come in close contact with the nozzle surface. In this way, the cap may often unevenly come into contact with the nozzle surface. Such uneven contact between the cap and the nozzle surface lowers sealing performance of the cap, and degrades the function of the cleaning mechanism.

To solve this problem, one technique is known to form a part of the cap that comes into contact with the nozzle surface using an elastic material, such as an elastomer. This technique ensures close contact and tight sealing between the cap and the nozzle surface by bringing the cap into contact with the nozzle surface with a relatively strong force and excessively deforming the elastomer.

However, a relatively large amount of energy is required to bring the cap into contact with the nozzle surface with a relatively strong force. This may require a larger motor to be used for the cleaning operation, and may increase the cost of the printer. This may also cause wear of a driving unit for operating the cap, and may reduce durability of the printer.

DISCLOSURE OF THE INVENTION

One aspect of the present invention is a liquid ejecting apparatus for ejecting a liquid toward a target. The liquid ejecting apparatus includes a liquid ejecting head including a nozzle surface that has a plurality of nozzles for ejecting the liquid. A cap includes an outer wall that defines an opening, which is closed by the nozzle surface. The outer wall comes into contact with the nozzle surface and the plurality of nozzles are covered by the cap when the nozzle surface closes the opening. An aspiration mechanism connected to the cap aspirates fluid in an inner space of the cap and drains the fluid from the inner space of the cap. The cap includes a partition wall that comes into contact with the nozzle surface and defines a plurality of chambers together with the nozzle surface and the outer wall when the nozzle surface closes the opening. The outer wall is formed to receive a first stress when coming into contact with the nozzle surface, and the partition wall is formed to receive a second stress less than the first stress when coming into contact with the nozzle surface.

Another aspect of the present invention is a liquid ejecting apparatus for ejecting a liquid toward a target. The liquid ejecting apparatus includes a liquid ejecting head including a nozzle surface that has a plurality of nozzles for ejecting the liquid. A cap includes an outer wall and a partition wall. The outer wall defines an opening that is closed by the nozzle surface. The partition wall divides the opening into a plurality of chambers. When the nozzle surface closes the opening, the plurality of nozzles are covered by the cap, the outer wall comes into contact with the nozzle surface, and the partition wall is spaced from the nozzle surface. An aspiration mechanism connected to the cap aspirates fluid in an inner space of the cap and drains the fluid from the inner space of the cap.

Another aspect of the present invention is a printer apparatus for ejecting a liquid toward a print surface. The printer apparatus includes a linearly movable printer head that stores the liquid. The printer head includes a nozzle surface that has a plurality of nozzles for ejecting droplets of the liquid toward the print surface. A cleaning mechanism cleans the plurality of nozzles when the printer head is placed at a home position. The cleaning mechanism includes a cap for covering the plurality of nozzles when the printer head is at the home position, and an aspiration mechanism, connected to the cap, for depressurizing an inner space of the cap and draining the fluid from the inner space of the cap when the cap covers the plurality of nozzles. The cap includes an outer wall and an inner wall that define a plurality of chambers in the cap, and the outer wall relatively strongly presses the nozzle surface and the inner wall relatively weakly presses the nozzle surface when the cap covers the plurality of nozzles.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

The following describes a liquid ejecting apparatus according to a first embodiment of the present invention, with reference to FIGS. 1 to 8.

Figure 1:
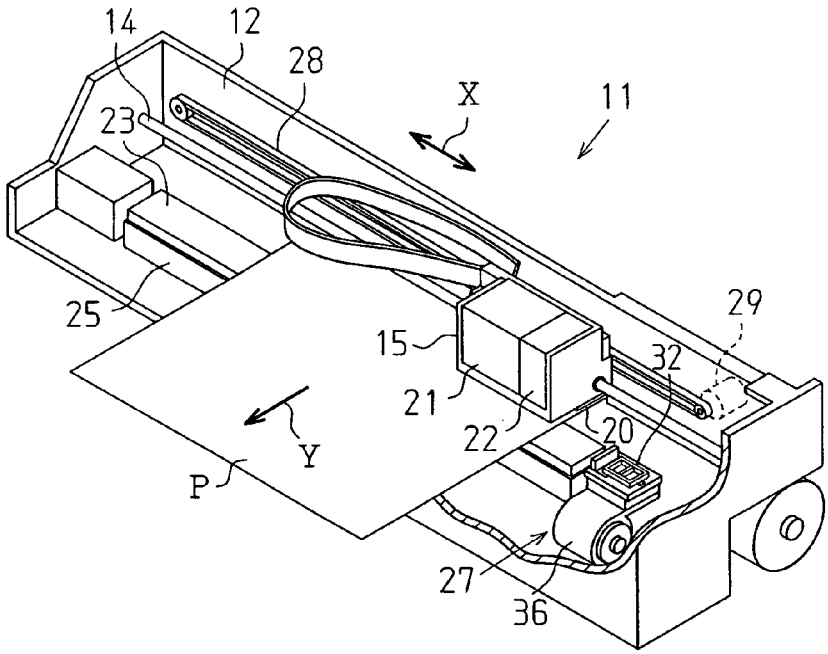
FIG. 1 is a perspective view of a printer according to a first embodiment of the present invention.

FIG. 1 shows a printer 11 as the liquid ejecting apparatus according to the first embodiment. The printer 11 includes a frame 12, a guide member 14, a carriage 15, a recording head 20 as a liquid ejecting head, a color ink cartridge 21, a reactive ink cartridge 22, a platen 23, a waste liquid tank 25, and a cleaning mechanism 27.

The frame 12 covers the entire apparatus part of the printer 11. Between both side-walls of the frame 12, the guide member 14 extends in the longitudinal direction of the frame 12. The guide member 14 is inserted through the carriage 15, and supports the carriage 15 in a slidable manner. The carriage 15 is connected to a carriage motor 29 via a timing belt 28. The carriage 15 reciprocates in a direction in which the guide member 14 extends, i.e., in a main-scanning direction X, when the carriage motor 29 is driven.

Figure 2:
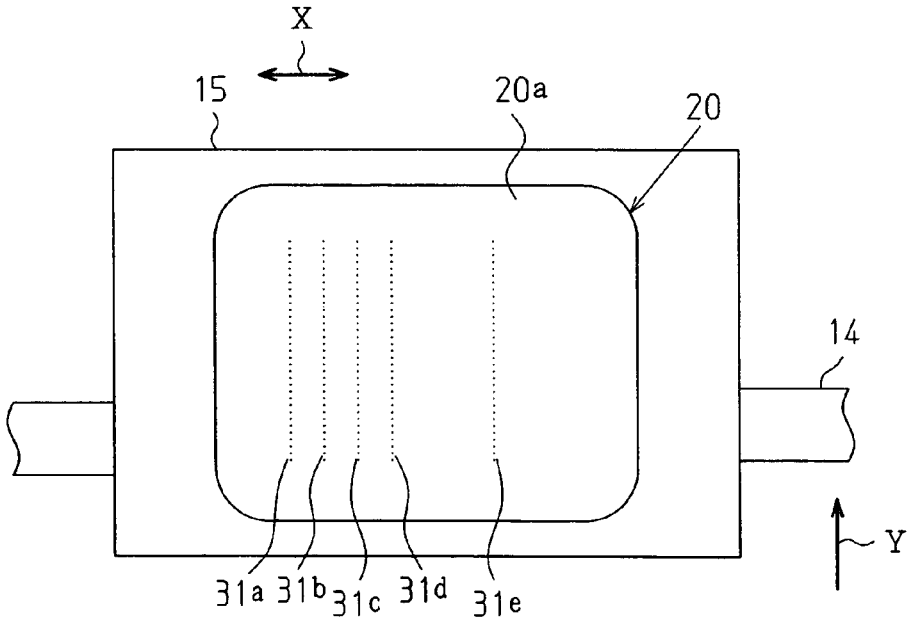
FIG. 2 is a bottom view of a carriage of the printer of FIG. 1.

The recording head 20 is mounted under the carriage 15. As shown in FIG. 2, a bottom surface of the recording head 20 is a nozzle surface 20*a* on which a plurality of nozzles are formed. In the first embodiment, as shown in FIG. 2, four nozzle rows 31*a* to 31*d* are formed in the left half of the nozzle surface 20*a*, and one nozzle row 31*e* is formed in the right half of the nozzle surface 20*a*.

As shown in FIG. 1, the color ink cartridge 21 and the reactive ink cartridge 22 are arranged on the carriage 15 in parallel with each other. The color ink cartridge 21 stores color ink. The reactive ink cartridge 22 stores reactive ink. The color ink and the reactive ink are respectively supplied from the cartridges 21 and 22 to the recording head 20 when a piezoelectric element (not shown) in the recording head 20 is driven.

The nozzle rows 31*a* to 31*d* eject, as ink droplets, the color ink supplied from the color ink cartridge 21. The nozzle row 31*e* ejects, as ink droplets, the reactive ink supplied from the reactive ink cartridge 22.

As shown in FIG. 1, the platen 23 is a holder for holding a paper sheet P as a target. The platen 23 is attached to the frame 12 to be parallel with the guide member 14 and to face the recording head 20. The recording head 20 faces the paper sheet P placed on the platen 23. A paper feeding mechanism (not shown) arranged on the platen 23 feeds the paper sheet P in a sub-scanning direction Y (refer to FIG. 1).

With the carriage 15 reciprocating along the guide member 14, the piezoelectric element is driven according to print data. Then, ink droplets are ejected from the recording head 20 toward the paper sheet P. In this way, printing is performed. In the first embodiment, ink droplets of the color ink are first ejected and then ink droplets of the reactive ink are ejected, so that the reactive ink droplets are adhered on the color ink droplets, which are adhered on the paper sheet P. The reactive ink and the color ink react and coagulate on the paper sheet P. This improves color reproduction and gloss of the color ink. In this way, an image with improved color reproduction and gloss is printed on the paper sheet P.

Figure 3:
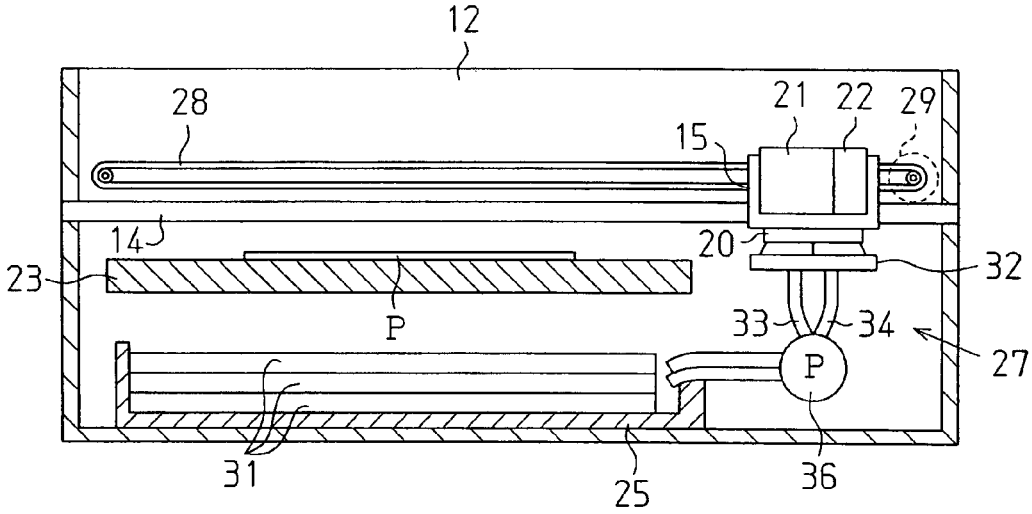
FIG. 3 is a sectional view of essential parts of the printer of FIG. 1.

As shown in FIGS. 1 and 3, the waste liquid tank 25 is formed as a case having a top opening. The arrangement position and the size of the waste liquid tank 25 are determined so that the entire bottom surface of the platen 23 is placed in the top opening of the waste liquid tank 25. As shown in FIG. 3, a plurality of waste liquid absorbing members 31 made from a porous material are placed one on top of another within the waste liquid tank 25.

As shown in FIGS. 1 and 3, the cleaning mechanism 27 is placed in a non-print area (at a home position) of the printer 11. For example, the cleaning mechanism 27 is placed in a right end part of the printer 11 shown in FIG. 3. The cleaning mechanism 27 includes a cap 32, and an aspiration mechanism connected to the cap 32. The aspiration mechanism includes aspiration tubes 33 and 34 and an aspiration pump 36. The aspiration tubes 33 and 34 connect the cap 32 and the waste liquid tank 25. The aspiration pump 36 is arranged midway on the aspiration tubes 33 and 34.

Figure 4:
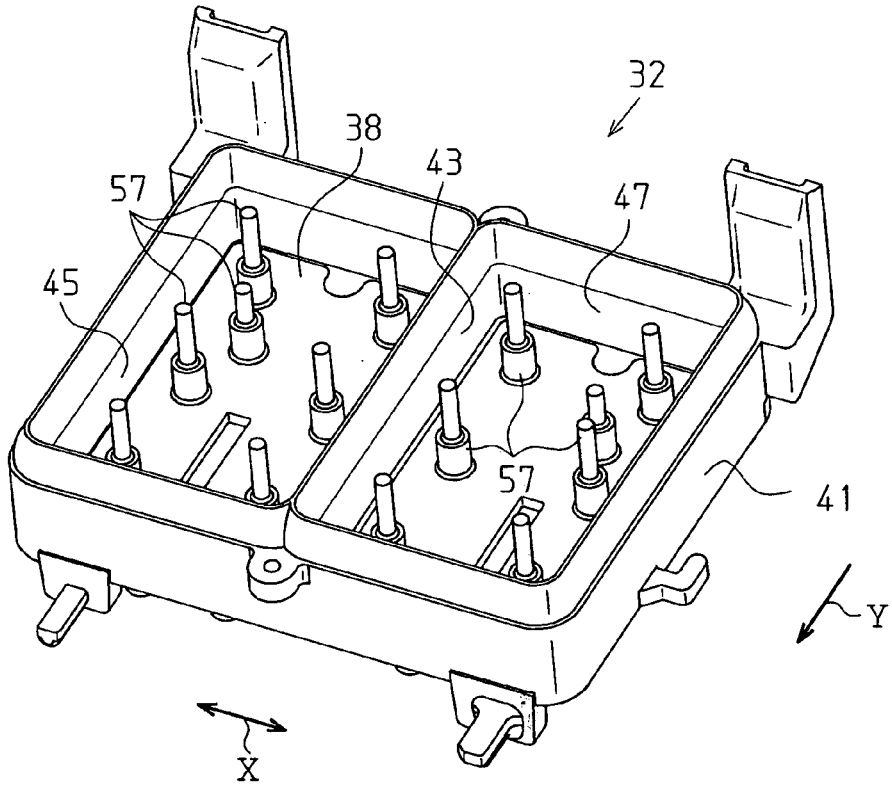
FIG. 4 is a perspective view of a cap of the printer of FIG. 1.
Figure 5:
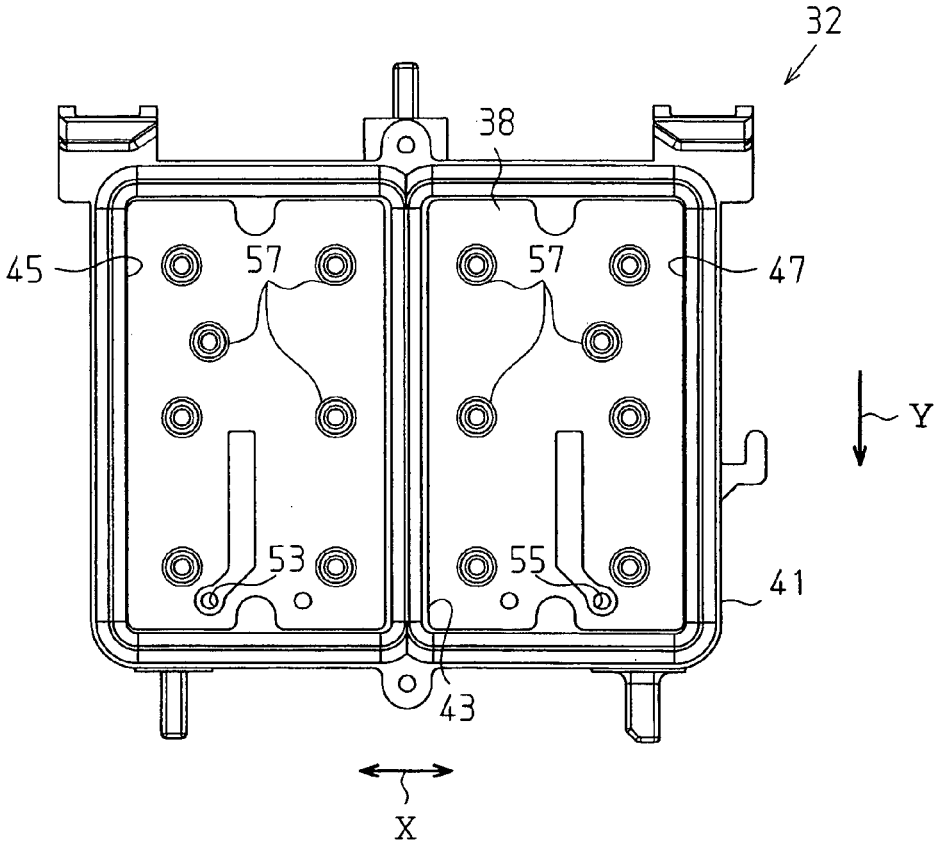
FIG. 5 is a plan view of the cap of FIG. 4.

As shown in FIGS. 4 and 5, the cap 32 includes a rectangular bottom surface 38 and an outer wall 41. The outer wall 41 is arranged along the outer rim of the bottom surface 38. The cap 32 is formed as a case having a top opening. In the first embodiment, the bottom surface 38 is a little smaller than the nozzle surface 20*a* of the recording head 20 (refer to FIG. 2). The cap 32 further includes a partition wall 43 in the middle of the bottom surface 38. The partition wall 32 extends in the sub-scanning direction Y.

The partition wall 43 is placed in the middle of the cap 32 as viewed in the main-scanning direction X. The partition wall 43 divides, into two, an inner space of the cap 32, which is defined by the bottom surface 38 and the outer wall 41 of the cap 32. To be specific, the bottom surface 38, the outer wall 41, and the partition wall 43 define a first case unit (partitioned chamber) 45 and a second case unit (partitioned chamber) 47 as shown in FIG. 5. The first case unit 45 and the second case unit 47 have substantially the same volume. Each of the first case unit 45 and the second case unit 47 has an opening, which is open to outside air.

Figure 6:
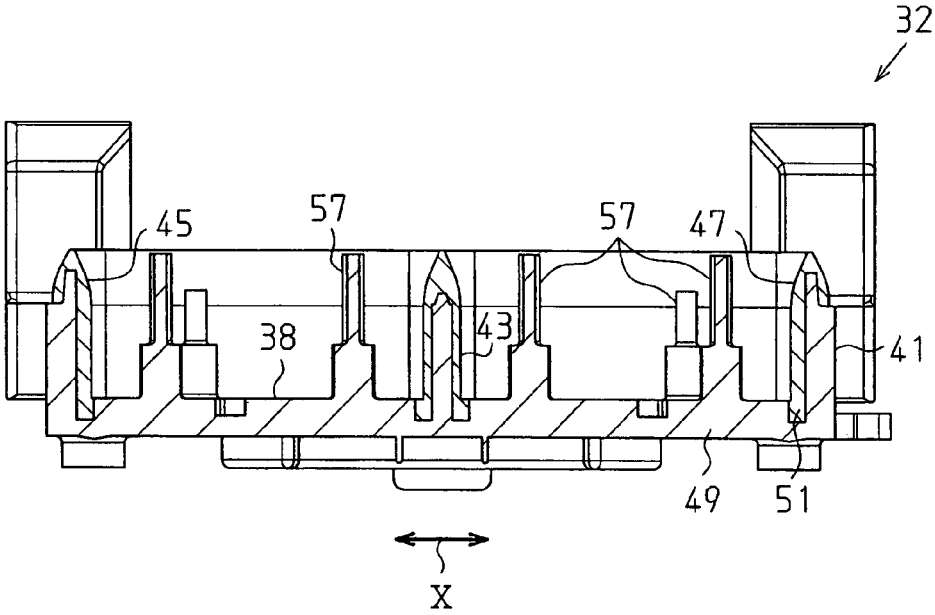
FIG. 6 is a sectional view of the cap of FIG. 4.

As shown in FIG. 6, the cap 32 has a core part 49, and an elastic part 51 as a contact part. The core part 49 is made from a resin material, such as plastic. The elastic part 51 is made from an elastic material, such as an elastomer. The core part 49 and the elastic part 51 are integrally formed, for example, by coinjection molding.

Figure 7:
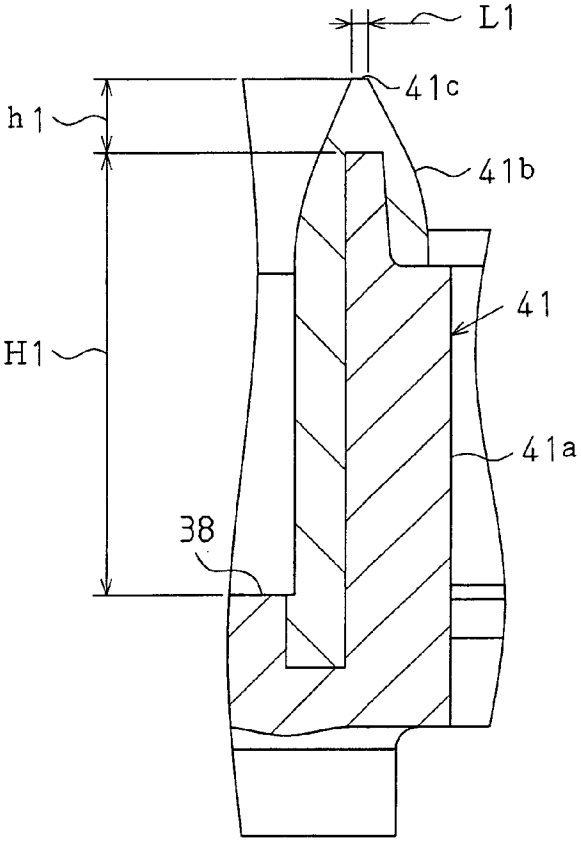
FIG. 7 is a partial sectional view of the cap of FIG. 4.
Figure 8:
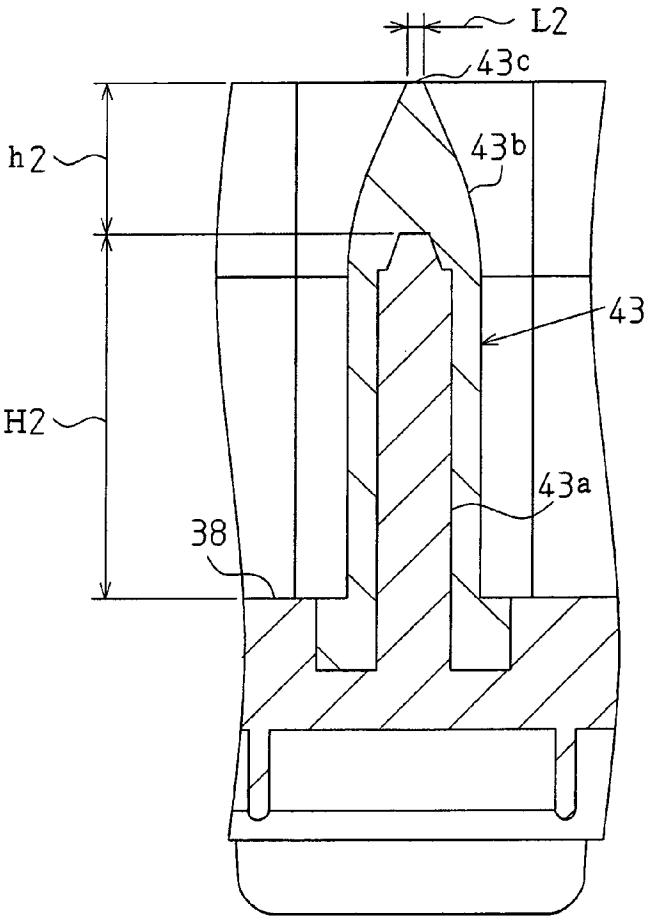
FIG. 8 is a partial sectional view of the cap of FIG. 4.

The following describes the outer wall 41 and the partition wall 43 in detail. As shown in FIG. 7, the outer wall 41 includes an outer-wall resin part 41*a* and an outer-wall elastic part 41*b*. The outer-wall resin part 41*a* is made from a resin material, and is arranged continuous from the bottom surface 38. The outer-wall elastic part 41*b* is made from an elastic material, and covers an upper edge and a side surface of the outer-wall resin parts 41*a*. As shown in FIG. 8, the partition wall 43 includes a partition-wall resin part 43*a* and a partition-wall elastic part 43*b*. The partition-wall resin part 43*a* is made from a resin material, and is arranged continuous from the bottom surface 38. The partition-wall elastic part 43*b* is made from an elastic material, and covers an upper edge and a side surface of the partition-wall resin part 43*a*.

As shown in FIG. 7, height H1 of the outer-wall resin part 41*a*, i.e., distance from the bottom surface 38 to the upper edge of the outer-wall resin part 41*a*, is uniform throughout the outer-wall resin part 41*a*. As shown in FIG. 8, height H2 of the partition-wall resin part 43*a* is uniform throughout the partition-wall resin part 43*a*. The height H2 is less than the height H1 (refer to FIG. 7).

As shown in FIG. 7, the outer-wall elastic part 41*b* projects from the upper edge of the outer-wall resin part 41*a* by height hl. In other words, distance from the upper edge of the outer-wall resin part 41*a* to the upper edge of the outer-wall elastic part 41*b* is the height h1. As shown in FIG. 8, the partition-wall elastic part 43*b* projects from the upper edge of the partition-wall resin part 43*a* by height h2. In other words, distance from the upper edge of the partition-wall resin part 43*a* to the upper edge of the partition-wall elastic member part 43*b* is the height h2. The projection height h2 is greater than the projection height h1.

Distance from the bottom surface 38 to the upper edge of the outer-wall elastic part 41*b* is equal to the distance from the bottom surface 38 to the upper edge of the partition-wall elastic part 43*b*. In other words, the height H1 plus the projection height h1 is equal to the height H2 plus the projection height h2.

The outer wall 41 and the partition wall 43 have the same entire height from the bottom surface 38. The outer wall 41 and the partition wall 43 are different in their ratios of the core part 49 and the elastic part 51 in the height direction. The ratio of the elastic part 51 in the partition wall 43 is higher than that in the outer wall 41. With this structure, the partition wall 43 is more elastically deformable than the outer wall 41.

The outer-wall elastic part 41*b* is tapered to its upper edge 41*c*. The partition-wall elastic part 43*b* is tapered to its upper edge 43*c*. Each of the upper edges 41*c* and 43*c* forms a flat planar surface parallel to the bottom surface 38. Width L1 of the upper edge 41*c* of the outer-wall elastic part 41*b* in the main-scanning direction X (refer to FIG. 6) is less than width L2 of the upper edge 43*c* of the partition-wall elastic part 43*b* in the main-scanning direction X.

As shown in FIG. 5, the case unit 45 has a first drain outlet 53 formed in the bottom surface 38, and the case unit 47 has a second drain outlet 55 formed in the bottom surface 38. As shown in FIGS. 4 and 5, each of the case units 45 and 47 has, on the bottom surface 38, seven substantially cylindrical supporting members 57, which project outward. An ink absorbing sheet (not shown) is placed in each of the case units 45 and 47. In each of the case units 45 and 47, the supporting members 57 pierce through the ink absorbing sheet, to fix the ink absorbing sheet to the case unit.

As shown in FIG. 3, the cap 32 is raised and lowered by a well-known raising and lowering mechanism (not shown), with its top opening oriented upward and its bottom surface 38 (refer to FIG. 4) parallel to the nozzle surface 20*a*. The raising and lowering mechanism is attached to the frame 12. When the carriage 15 is moved to the home position, the cap 32 is raised, and is brought into contact with the nozzle surface 20*a* (refer to FIG. 2) of the recording head 20 of the carriage 15.

When the cap 32 and the nozzle surface 20*a* come into contact with each other, the nozzle rows 31*a* to 31*d* (refer to FIG. 2) are covered by the first case unit 45, and the nozzle row 31*e* (refer to FIG. 2) is covered by the second case unit 47.

The aspiration tubes 33 and 34 are made from an elastic material, such as silicon rubber. One end of the aspiration tube 33 is connected to the first drain outlet 53 (refer to FIG. 5) of the cap 32. One end of the aspiration tube 34 is connected to the second drain outlet 55 (refer to FIG. 5) of the cap 32. The other ends of the aspiration tubes 33 and 34 are placed in the waste liquid tank 25. An inner space of the first case unit 45 of the cap 32 is in fluid communication with the waste liquid tank 25 via the aspiration tube 33. An inner space of the second case unit 47 of the cap 32 is in fluid communication with the waste liquid tank 25 via the aspiration tube 34. In this way, the first and second case units 45 and 47 are separately connected to the waste liquid tank 25.

The aspiration pump 36 is arranged midway on fluid-flow paths of the aspiration tubes 33 and 34. The aspiration pump 36 aspirates various fluids flowing upstream of the aspiration tubes 33 and 34, such as air and ink. An inner space defined by the recording head 20 and the cap 32 is depressurized when the aspiration pump 36 is driven with the nozzle surface 20*a* (refer to FIG. 2) of the recording head 20 being sealed by the cap 32.

The following describes the cleaning operation for the printer 11.

In the cleaning operation, the carriage 15 is first moved to the home position (FIG. 3). The cap 32 is raised by the raising and lowering mechanism, so that the nozzle surface 20*a* of the recording head 20 of the carriage 15 comes into contact with the cap 32. The nozzle rows 31*a* to 31*d* (refer to FIG. 2) on the nozzle surface 20*a* are covered by the first case unit 45 (refer to FIG. 5) of the cap 32, and the nozzle row 31*e* (refer to FIG. 2) is covered by the second case unit 47 (refer to FIG. 5) of the cap 32.

Here, the upper edges of the outer wall 41 and the partition wall 43 of the cap 32 are pressed against the nozzle surface 20*a*. The partition wall 43 is formed more elastically deformable than the outer wall 41. Thus, stress generated between the partition wall 43 of the cap 32 and the nozzle surface 20*a* is less than stress generated between the outer wall 41 of the cap 32 and the nozzle surface 20*a*.

In other words, in the cleaning operation, the outer wall 41 preferentially comes in close contact with the nozzle surface 20*a* with larger stress, compared with the partition wall 43. As a result, the inner space of the cap 32 is effectively sealed from outside air.

When the aspiration pump 36 is driven in this state, fluids in the inner space defined by the recording head 20 and the cap 32 are aspirated. As a result, the inner space is depressurized, so that color ink and reactive ink are aspirated out of the nozzle rows 31*a* to 31*e* on the nozzle surface 20*a* of the recording head 20. In this way, the ability of the recording head 20 to eject ink droplets is restored. The aspirated color ink is drained into the waste liquid tank 25 via the first case unit 45 and the aspiration tube 33. The aspirated reactive ink is drained into the waste liquid tank 25 via the second case unit 47 and the aspiration tube 34.

With this cleaning operation, the color ink and the reactive ink are guided to the waste liquid tank 25 via separate routes, i.e., via a route including the case unit 45 and the aspiration tube 33, and a route including the case unit 47 and the aspiration tube 34, respectively. This prevents the color ink and the reactive ink from being mixed in the cap 32 or in the aspiration tubes. The color ink and the reactive ink do not react and do not coagulate in the cap 32 or in the aspiration tubes. Thus, cleaning efficiency is not degraded.

Contrary to the first embodiment, the following considers the situation in which the outer wall 41 is formed more elastically deformable than the partition wall 43. In the cleaning operation in this case, the partition wall 43 preferentially comes in close contact with the nozzle surface 20*a* with larger stress, compared with the outer wall 41. In this state, the partition wall 43 exhibits high sealing performance to separate the first case unit 45 from the second case unit 47, whereas sealing performance of the outer wall 41 is lowered. The lowered sealing performance of the outer wall 41 makes it difficult to depressurize the inner space defined by the recording head 20 and the cap 32. Compared with the first embodiment, the cleaning efficiency is degraded in this case.

In the first embodiment, the partition wall 43 is more elastically deformable than the outer wall 41. This structure gives preference to sealing between the outer wall 41 and the outside over sealing between the first case unit 45 and the second case unit 47. In this way, sealing between the cap 32 and the nozzle surface 20*a* is given appropriate preference depending on parts thereof.

Stress generated between the partition wall 43 and the nozzle surface 20*a* is less than stress generated between the outer wall 41 and the nozzle surface 20*a*. With such a smaller stress, the partition wall 43 tends to exhibit low sealing performance. In other words, sealing between the partition wall 43 and the nozzle surface 20*a* may become less tight than sealing between the outer wall 41 and the nozzle surface 20*a*. However, the width L1 of the upper edge 41*c* of the outer wall 41 is less than the width L2 of the upper edge 43*c* of the partition wall 43 as shown in FIGS. 7 and 8. This means that the partition wall 43 more easily comes in close contact with the nozzle surface 20*a* than the outer wall 41. In this way, the shape of the upper edge 43*c* compensates for such low sealing performance of the partition wall 43.

The First Embodiment has the Effects Described Below (1) The cap 32 is brought into contact with the nozzle surface 20*a* of the recording head 20, so that the nozzle rows 31*a* to 31*e* are covered by the cap 32. The aspiration pump 36 is driven in this state, so that the inner pressure of the cap 32 is decreased, and ink is aspirated out of the nozzle rows 31*a* to 31*e* on the recording head 20. In this way, the cleaning operation is performed. The outer wall 41 comes into contact with the nozzle surface 20*a* with larger stress, compared with the partition wall 43. Thus, the outer wall 41 preferentially comes into contact with the nozzle surface 20*a*, compared with the partition wall 43. This structure ensures tight sealing between the outer wall 41 and the nozzle surface 20*a*. In this way, sealing performance of the outer wall 41 is given preference over sealing performance of the partition wall 43. Thus, the inner pressure of the cap 32 is sufficiently decreased, and the cleaning operation is reliably performed.

The characteristic structure of the cap 32 improves the degree of sealing between the outer wall 41 and the nozzle surface 20*a*. Thus, the amount of energy required to drive the cap 32 does not need to be increased. This prevents an increase in the manufacturing cost or in the running cost of the printer 11.

(2) The outer wall 41 and the partition wall 43 are formed by the core part 49 and the elastic part 51. When the cap 32 is brought into contact with the nozzle surface 20*a*, the elastic part 51 comes into contact with the nozzle surface 20*a*. This improves the degree of sealing between the cap 32 and the nozzle surface 20*a*.

(3) The height H2 of the partition-wall resin part 43*a* is less than the height H1 of the outer-wall resin part 41*a*. Thus, the distance from the partition-wall resin part 43*a* to the nozzle surface 20*a* is greater than the distance from the outer-wall resin part 41*a* to the nozzle surface 20*a* when the cap 32 is into contact with the nozzle surface 20*a*. In this way, a relatively simple structure reliably enables the partition wall 43 to come into contact with the nozzle surface 20*a* with smaller stress compared with the outer wall 41.

(4) The projection height h2 of the partition-wall elastic part 43*b* is greater than the projection height hi of the outer-wall elastic part 41*b*. In other words, the partition-wall elastic part 43*b* has a greater thickness, in the direction of contact with the nozzle surface 20*a*, than the outer-wall elastic part 41*b*. With the elastic part 51 of the partition wall 43 being thicker than the elastic part 51 of the outer wall 41, the partition wall 43 is more elastically deformable than the outer wall 41. In this way, a relatively simple structure reliably enables the partition wall 43 to come into contact with the nozzle surface 20*a* with smaller stress compared with the outer wall 41, when the cap 32 is brought into contact with the nozzle surface 20*a*.

(5) The upper edges 41*c* and 43*c* of the elastic parts 41*b* and 43*b* form flat planar surfaces parallel to the bottom surface 38. The width L1 of the upper edge 41*c* of the outer-wall elastic part 41*b* is less than the width L2 of the upper edge 43*c* of the partition-wall elastic part 43*b*. This structure increases the degree of contact between the partition wall 43 and the nozzle surface 20*a* when the cap 32 is brought into contact with the nozzle surface 20*a*. With the partition wall 43 having a smaller stress on the nozzle surface 20*a* than the outer wall 41, the partition wall 43 tends to exhibit low sealing performance. In other words, sealing between the partition wall 43 and the nozzle surface 20*a* may become less tight than sealing between the outer wall 41 and the nozzle surface 20*a*. However, the increased degree of contact compensates for such low sealing performance of the partition wall 43.

The following describes a liquid ejecting apparatus according to a second embodiment of the present invention, with reference to FIGS. 9 to 14. The liquid ejecting apparatus of the second embodiment has the same structure as the printer 11 of the first embodiment except for components corresponding to the partition wall 43 and the aspiration mechanism of the printer 11 of the first embodiment. The following describes differences between the second embodiment and the first embodiment.

Figure 10:
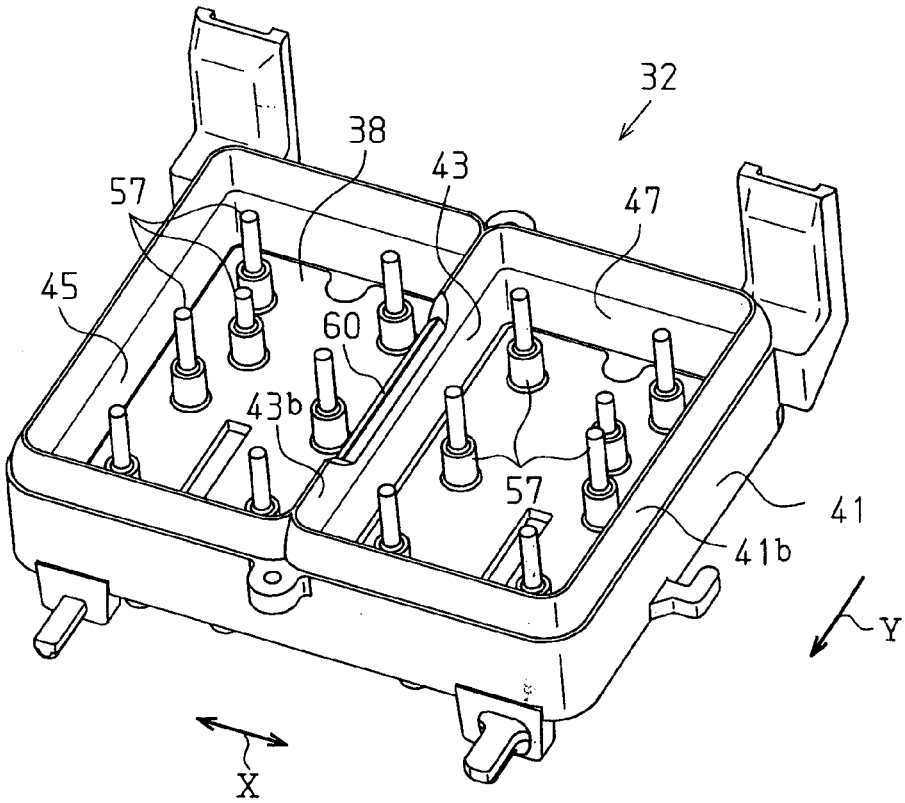
FIG. 10 is a perspective view of a cap of the printer of FIG. 9.
Figure 12:
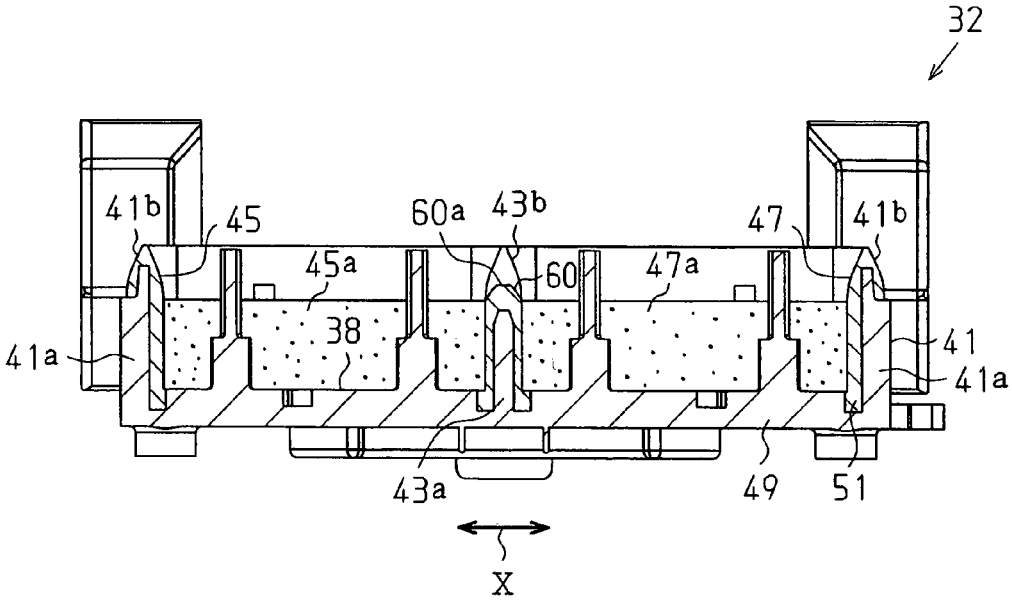
FIG. 12 is a sectional view of the cap of FIG. 10.

As shown in FIG. 10, a cap 32 is formed substantially as a case having a top opening. A partition wall 43 extends in a sub-scanning direction Y, to connect two facing surfaces of an outer wall 41 extending in a scanning direction X. The partition wall 43 separates a first case unit 45 at left of the partition wall 43 and a second case unit 47 at right of the partition wall 43 in FIG. 10. As shown in FIG. 12, the partition wall 43 includes a partition-wall resin part 43*a*, which is continuous to a bottom surface 38 of the cap 32. Height H3 of the partition-wall resin part 43*a*, i.e., distance from the bottom surface 38 to the upper edge of the resin part 43*a*, is uniform in the sub-scanning direction Y. The height H3 is less than the height H2 of the partition-wall resin part 43*a* in the first embodiment.

Figure 13:
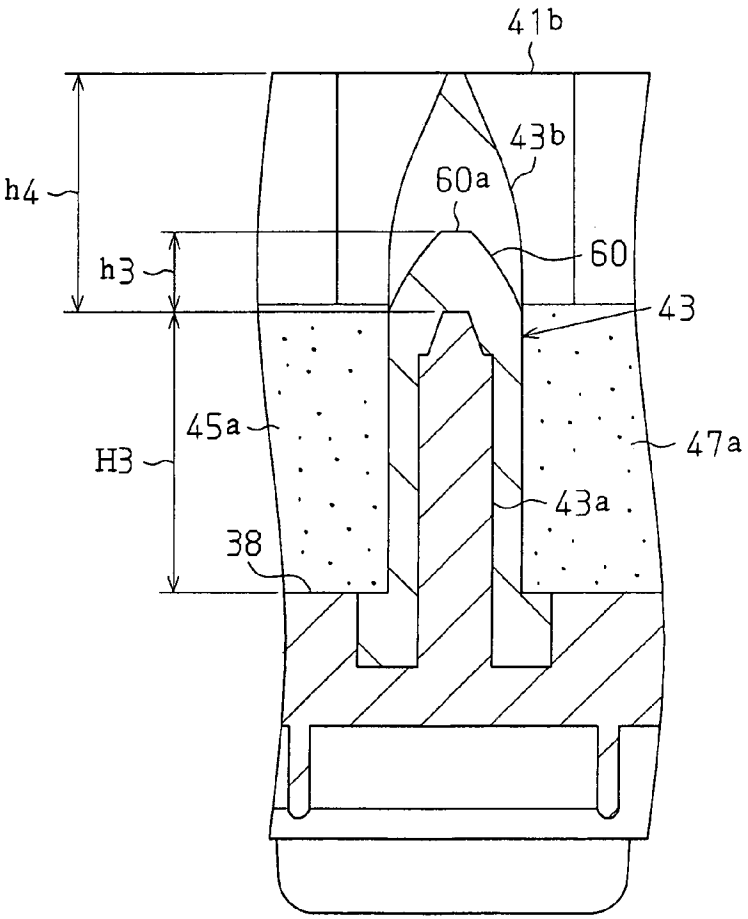
FIG. 13 is a partial sectional view of the cap of FIG. 10.

As shown in FIG. 12, the upper edge and the side surface of the partition-wall resin part 43*a* are covered by a partition-wall elastic part 43*b*. The partition-wall elastic part 43*b* projects from the upper edge of the partition-wall resin part 43*a* by height h4 as shown in FIG. 13. In other words, distance from the upper edge of the partition-wall resin part 43*a* to the upper edge of the partition-wall elastic part 43*b* is the height h4. The projection height h4 is greater than the projection height hl (refer to FIG. 7) of the outer-wall elastic part 41*b*. Distance from the bottom surface 38 to the upper edge of the outer-wall elastic part 41*b* is equal to the distance from the bottom surface 38 to the upper edge of the partition-wall elastic part 43*b*.

Figure 11:
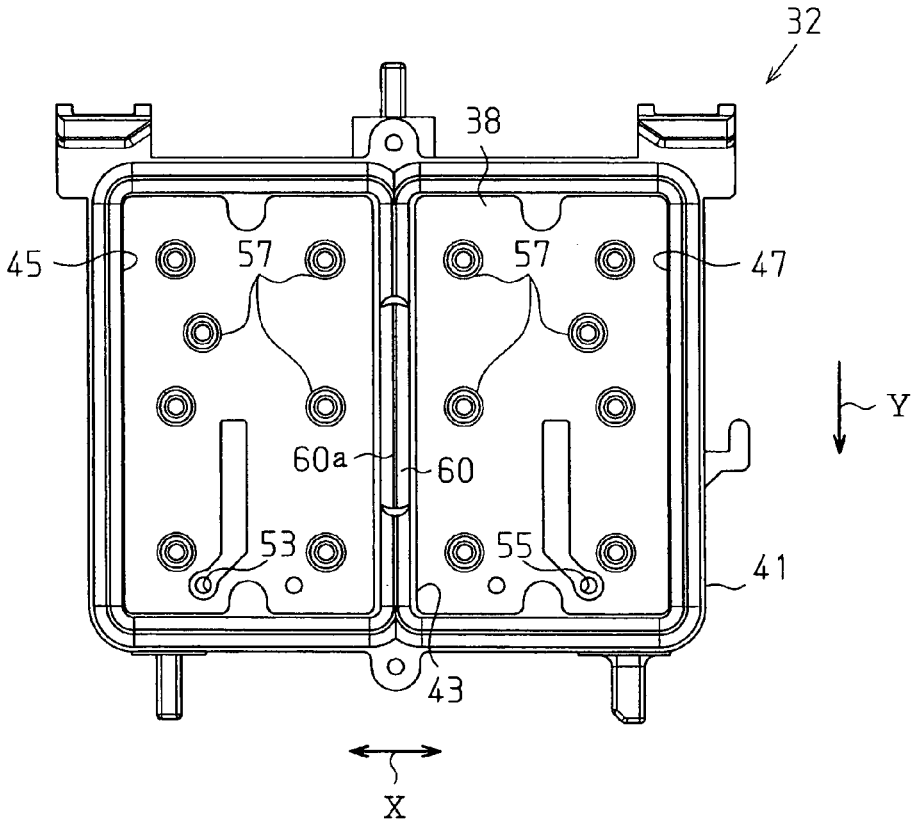
FIG. 11 is a plan view of the cap of FIG. 10.

As shown in FIGS. 10 and 11, the partition-wall elastic part 43*b* has a cut part, i.e., a step part 60, in its middle vicinity as viewed in the sub-scanning direction Y. The step part 60 is formed by partially cutting the upper edge of the partition-wall elastic part 43*b*. As shown in FIGS. 12 and 13, in the same manner as the partition-wall elastic part 43*b*, the step part 60 is tapered to its upper edge 60*a* (in the direction of the nozzle surface 20*a*).

As shown in FIG. 13, the step part 60 of the partition-wall elastic part 43*b* projects from the upper edge of the partition-wall resin part 43*a* by height h3. The projection height h3 of the step part 60 of the partition-wall elastic part 43*b* is less than the projection height h4 of the part of the partition-wall elastic part 43*b* other than the step part 60. The projection height h3 is determined so that the upper edge 60*a* of the step part 60 does not come into contact with the nozzle surface 20*a* when the outer-wall elastic part 41*b* is brought into contact with and pressed against the nozzle surface 20*a*. The projection height h3 is determined so that the upper edge 60*a* projects from top surfaces (surfaces closer to the nozzle surface 20*a*) of a first and second ink absorbing sheets 45*a* and 47*a* (refer to FIG. 12), which are placed in the first and second case units 45 and 47, respectively.

When the upper edge of the outer wall 41 (the outer-wall elastic part 41*b*) is brought into contact with and pressed against the nozzle surface 20*a* by a raising and lowering mechanism, the upper edge of the partition-wall elastic part 43*b* is also brought into contact with and pressed against the nozzle surface 20*a* at the same time. This causes a first partitioned chamber S1 and a second partitioned chamber S2 respectively corresponding to the first and second case units 45 and 47 to be sealed between the cap 32 and the nozzle surface 20*a* as shown in FIG. 14.

Here, the step part 60 and the nozzle surface 20*a* define a connection path 61, which connects the first and second partitioned chambers S1 and S2 with each other. The connection path 61 facilitates elastic deformation of the partition-wall elastic part 43*b*, which is pressed against the nozzle surface 20*a*. To be specific, a portion of the partition-wall elastic part 43*b* is deformed elastically toward the connection path 61 (the step part 60).

Figure 14:
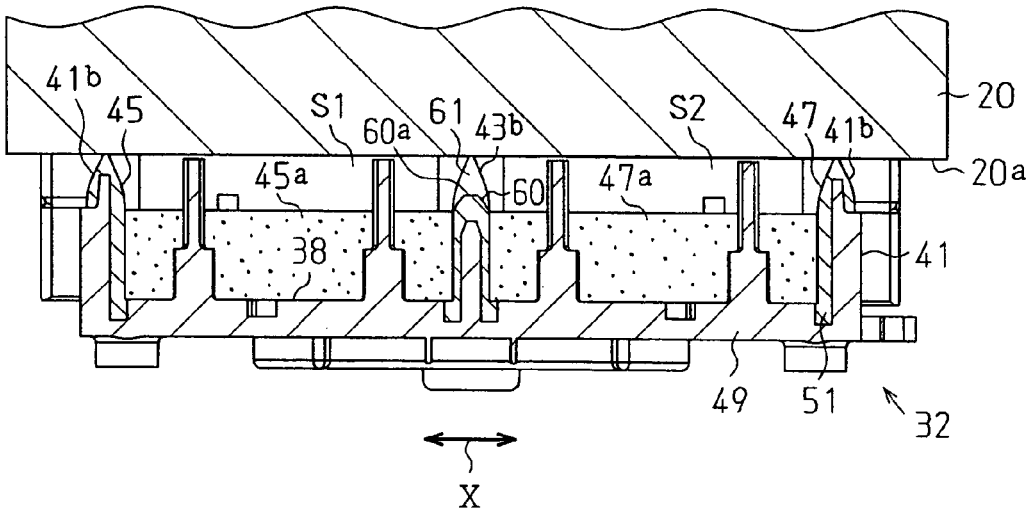
FIG. 14 is a sectional view of the cap of FIG. 10.

When the outer-wall elastic part 41*b* is pressed against the nozzle surface 20*a* as shown in FIG. 14, a portion of the partition-wall elastic part 43*b* is deformed elastically toward the connection path 61. This elastic deformation decreases stress placed on the nozzle surface 20*a* by the partition-wall elastic part 43*b*. This enables the partition wall 43 to be pressed against the nozzle surface 20*a* with smaller stress, compared with the outer wall 41.

Figure 9:
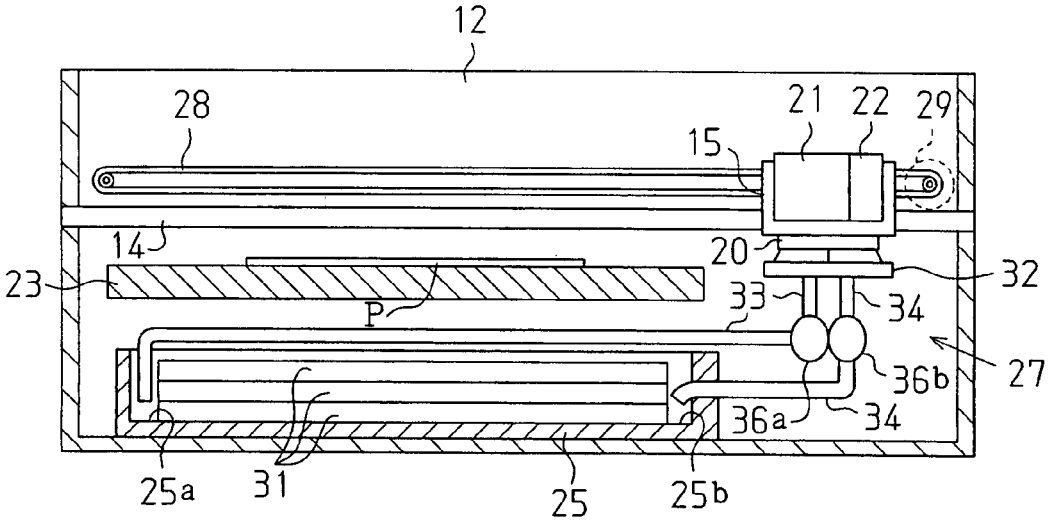
FIG. 9 is a sectional view of essential parts of the printer according to a second embodiment of the present invention.

As shown in FIG. 9, two aspiration tubes 33 and 34 are respectively connected to a first and second drain outlets 53 and 55 (refer to FIG. 11), which are formed in the bottom surface 38 of the cap 32. A waste liquid tank 25 has a left space 25*a* and a right space 25*b* divided at both sides of a set of waste liquid absorbing members 31 placed in the waste liquid tank 25. The aspiration tube 33 connects the first partitioned chamber S1 to the left space 25*a*. The aspiration tube 34 connects the second partitioned chamber S2 to the right space 25*b*. A first aspiration pump 36*a* is arranged midway on the aspiration tube 33. A second aspiration pump 36*b* is arranged midway on the aspiration tube 34.

The first and second aspiration pumps 36*a* and 36*b* aspirate various fluids flowing upstream of the aspiration tubes 33 and 34, such as air and ink, to depressurize the first and second partitioned chambers S1 and S2.

When the first and second partitioned chambers S1 and S2 are depressurized, the outer wall 41 (the outer-wall elastic part 41*b*) preferentially comes in close contact with the nozzle surface 20*a*, and the partition wall 43 comes into contact with the nozzle surface 20*a* with smaller stress compared with the outer wall 41. As a result, the inner space of the cap 32 (the first and second partitioned chambers S1 and S2) is effectively sealed from outside air.

The first and second partitioned chambers S1 and S2 are connected by the connection path 61. This means that the first and second partitioned chambers S1 and S2 have the same pressure. Color ink and reactive ink are aspirated by a capacity according to negative pressure of the first and second partitioned chambers S1 and S2. In other words, the color ink and the reactive ink are aspirated by substantially the same capacity. The aspirated color ink and the aspirated reactive ink are absorbed by the first and second ink absorbing sheets 45*a* and 47*a*, respectively.

The aspirated color ink and the aspirated reactive ink are drained from the first and second partitioned chambers S1 and S2 into the left space 25*a* and the right space 25*b* of the waste liquid tank 25 as fluids containing air, via the aspiration tubes 33 and 34, respectively. The color ink and the reactive ink drained into the waste liquid tank 25 are absorbed by the waste liquid absorbing members 31 while spreading from both ends toward middle of the waste liquid absorbing members 31. In this way, the color ink and the reactive ink aspirated in the first and second partitioned chambers S1 and S2 reach substantially the middle position of the waste liquid absorbing members 31 without being mixed with each other, and are stored in the waste liquid tank 25.

The Second Embodiment has the Effects Described Below (1) The step part 60 of the partition wall 43 (the partition-wall elastic part 43*b*) forms the connection path 61, which connects the first and second partitioned chambers S1 and S2 in the cleaning operation. The connection path 61 allows a portion of the partition-wall elastic part 43*b*, which is pressed against the nozzle surface 20*a*, to be deformed elastically toward the connection path 61 (the step part 60). Such elastic deformation of the partition-wall elastic part 43*b* causes stress put on the nozzle surface 20*a* by the partition wall 43 to be less than stress put on the nozzle surface 20*a* by the outer wall 41. Thus, the outer wall 41 preferentially comes in close contact with the nozzle surface 20*a* compared with the partition wall 43. This effectively ensures tight sealing between the outer wall 41 and the nozzle surface 20*a*. As a result, the inner pressure of the cap 32 is sufficiently decreased. The cleaning operation is reliably performed without increasing the amount of energy required to drive the raising and lowering mechanism for raising the cap 32, etc.

(2) The connection path 61 enables the first and second partitioned chambers S1 and S2 to have an equivalent inner pressure. Thus, the first and second partitioned chambers S1 and S2 are depressurized to substantially the same pressure. This enables the amount of color ink aspirated into the first partitioned chamber S1 and the amount of reactive ink aspirated into the second partitioned chambers S2 to be substantially the same. Also, cleaning failures caused by insufficient aspirating of ink are reduced.

(3) Ink aspirated in the first partitioned chamber S1 and ink aspirated in the second partitioned chamber S2 are separately drained into the left space 25*a* and the right space 25*b* of the waste liquid tank 25 by the aspiration pumps 36*a* and 36*b* and the aspiration tubes 33 and 34, respectively. In this way, the color ink and the reactive ink are drained out via separate routes. Thus, the color ink and the reactive ink are not mixed and do not coagulate during aspirating. The color ink and the reactive ink are reliably absorbed by the waste liquid absorbing members 31. As a result, the aspirating ability of the cleaning mechanism 27 is not degraded, and the cleaning operation is performed more reliably.

It should be apparent to those skilled in the art that the present invention may be embodied in many other specific forms without departing from the spirit or scope of the invention. Particularly, it should be understood that the present invention may be embodied in the following forms.

The distance from the bottom surface 38 to the upper edge of the outer-wall elastic member 41*b* may be greater than the distance from the bottom surface 38 to the upper edge of the partition-wall elastic part 43*b*. In other words, the distance between the partition wall 43 and the nozzle surface 20*a* may be greater than the distance between the outer wall 41 and the nozzle surface 20*a* when the cap 32 is not into contact with the nozzle surface 20*a*. The partition-wall elastic part 43*b* may come into contact with the nozzle surface 20*a* when the outer-wall elastic member 41*b* is into contact with the nozzle surface 20*a*. Alternatively, the partition-wall elastic part 43*b* may be spaced from the nozzle surface 20*a* when the outer-wall elastic part 41*b* comes into contact with the nozzle surface 20*a*.

In this case, a simple structure, with only the height of the partition wall 43 being changed, more reliably enables stress put on the nozzle surface 20*a* by the partition wall 43 to be less than stress put on the nozzle surface 20*a* by the outer wall 41.

The shape of the partition wall 43 may be modified so that the distance between the partition wall 43 and the nozzle surface 20*a* becomes smaller at locations closer to the outer wall 41 when the cap 32 is not into contact with the nozzle surface 20*a*. An upper surface of the partition wall 43 may include an inclined surface (straight or arch) that gradually increases in height toward the outer wall 41.

The partition wall 43 has a greater distance from the nozzle surface 20*a* at locations farther from the outer wall 41. When the cap 32 is brought into contact with the nozzle surface 20*a*, a middle part of the cap 32 is easily stress-deformed in the direction of the nozzle surface 20*a*. However, this structure enables stress between the partition wall 43 and the nozzle surface 20 to be maintained small regardless of such stress-deformation. Thus, sealing performance of the outer wall 41 is more reliably provided.

Figure 15:
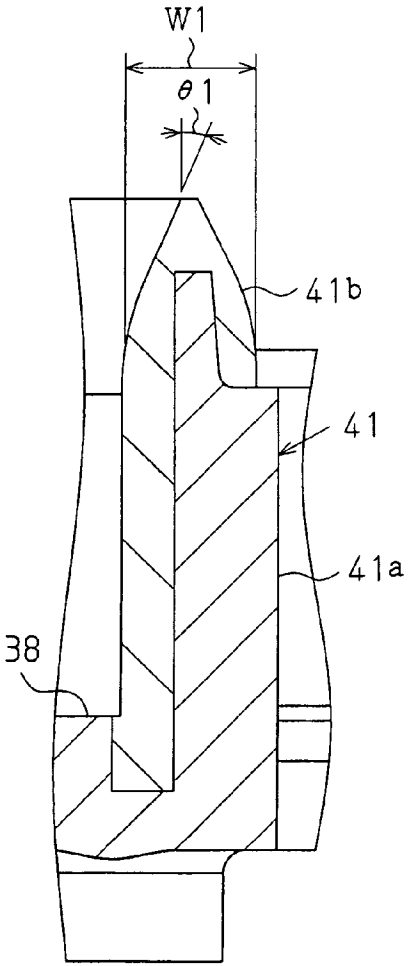
FIGS. 15 and 16 are partial sectional views of a cap according to a first modification of the present invention.
Figure 16:
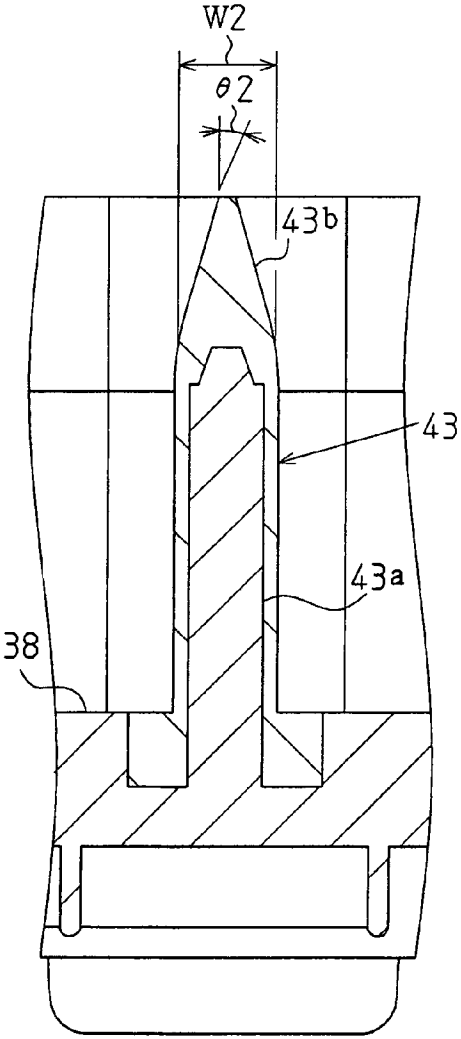

The pressing force of the partition wall 43 and of the outer wall 41 against the nozzle surface 20*a* may be adjusted by adjusting the thickness of the outer wall 41 and of the partition wall 43. As shown in FIGS. 15 and 16, for example, thickness W2 of the partition wall 43 may be set less than thickness W1 of the outer wall 41. In this case, a simple structure with the partition wall 43 being thinner than the outer wall 41 enables desired effects to be obtained.

An angle formed by each of two inclined side surfaces that define the tapered upper edge of the outer-wall elastic part 41*b* and a plane vertical to the bottom surface 38 is assumed to be an inclined angle θ1. An angle formed by each of two inclined side surfaces that define the tapered upper edge of the partition-wall elastic part 43*b* and the plane vertical to the bottom surface 38 is assumed to be an inclined angle θ2. In this case, the inclined angle θ2 may be set smaller than the inclined angle θ1, so that the thickness W2 of the partition wall 43 becomes substantially less than the thickness W1 of the outer wall 41. Such a simple structure also enables desired effects to be obtained.

In the first embodiment, the height H2 of the resin part 43*a* is less than the height H1 of the resin part 41*a*. The relationship between the heights H1 and H2 may be changed as long as stress generated between the partition wall 43 and the nozzle surface 20*a* is less than stress generated between the outer wall 41 and the nozzle surface 20*a*.

In the second embodiment, the height H3 of the partition-wall resin part 43*a* may be, for example, the same as the height H2, or may be greater than the height H1 of the outer-wall resin part 41*a*. The height H3 may be appropriately determined so that stress put on the nozzle surface 20*a* by the partition wall 43 is less than stress put on the nozzle surface 20*a* by the outer wall 41, and that the connection path 61 is formed.

The relationship between the projection height h2 of the elastic part 43*b* and the projection height hl of the elastic part

41*b* may be changed as long as stress generated between the partition wall 43 and the nozzle surface 20*a* is less than stress generated between the outer wall 41 and the nozzle surface 20*a* when the cap 32 comes into contact with the nozzle surface 20*a*.

The width L1 of the upper edge 41*c* of the elastic part 41*b* may be equal to or greater than the width L2 of the upper edge 43*c* of the elastic part 43*b*. The shapes of the upper edges 41*c* and 43*c* may be other than the flat planar surfaces parallel to the bottom surface 38.

In the above embodiments, the elastic parts 41*b* and 43*b*, and the step part 60 taper off in the direction of the nozzle surface 20*a*. At least one of the elastic parts 41*b* and 43*b*, and the step part 60 may not taper off.

In the above embodiments, the cap 32 has one partition wall 43 that divides the inner space of the cap 32 into two. The cap 32 may have two or more partition walls 43 that divide the inner space into three or more. In this case, the partition walls 43 are formed so that stress between each partition wall 43 and the nozzle surface 20*a* is less than stress between the outer wall 41 and the nozzle surface 20*a* when the cap 32 is brought into contact with the nozzle surface 20*a*. Here, aspiration pumps and aspiration tubes corresponding in one-to-one to chambers partitioned by the partition walls 43 may be arranged, and each partitioned chamber may be aspirated by an independent aspiration pump and an independent aspiration tube.

The partition wall 43 should not be limited to the linear shape in the sub-scanning direction Y, but may be other shapes such as a curved shape or a linear shape perpendicular to the sub-scanning direction Y.

In the second embodiment, the upper edge 60*a* of the step part 60 projects from the top surfaces of the first and second ink absorbing sheets 45*a* and 47*a* as shown in FIG. 13. The present invention should not be limited to such a structure. For example, the upper edge 60*a* of the step part 60 may be at the same level as the top surfaces of the first and second ink absorbing sheets 45*a* and 47*a*, or may be at a lower level than the top surfaces of the first and second ink absorbing sheets 45*a* and 47*a*. The projection height h3 of the step part 60 is determined so that the first and second ink absorbing sheets 45*a* and 47*a* placed in the cap 32 do not overlap with each other, and that the upper edge 60*a* of the step part 60 does not come into contact with the nozzle surface 20*a*.

In the second embodiment, the partition-wall resin part 43*a* has the height H3, which is uniform in the sub-scanning direction Y. However, for example, a middle vicinity part of the partition-wall resin part 43*a* in the sub-scanning direction Y may be formed to have a smaller height than the other parts, according to the shape of the step part 60.

In the second embodiment, the partition-wall elastic part 43*b* has one step part 60 in its middle in the sub-scanning direction Y. The present invention should not be limited to such a structure. For example, the partition-wall elastic part 43*b* may have the step part 60 at one end, or may have a plurality of step parts 60 in the sub-scanning direction Y. The position, number, and shape of the step part(s) 60 may be freely determined as long as the step part 60 forms the communication path 60 and allows a portion of the partition-wall elastic part 43*b* to be elastically deformed in the direction of the communication path 60.

Figure 17:
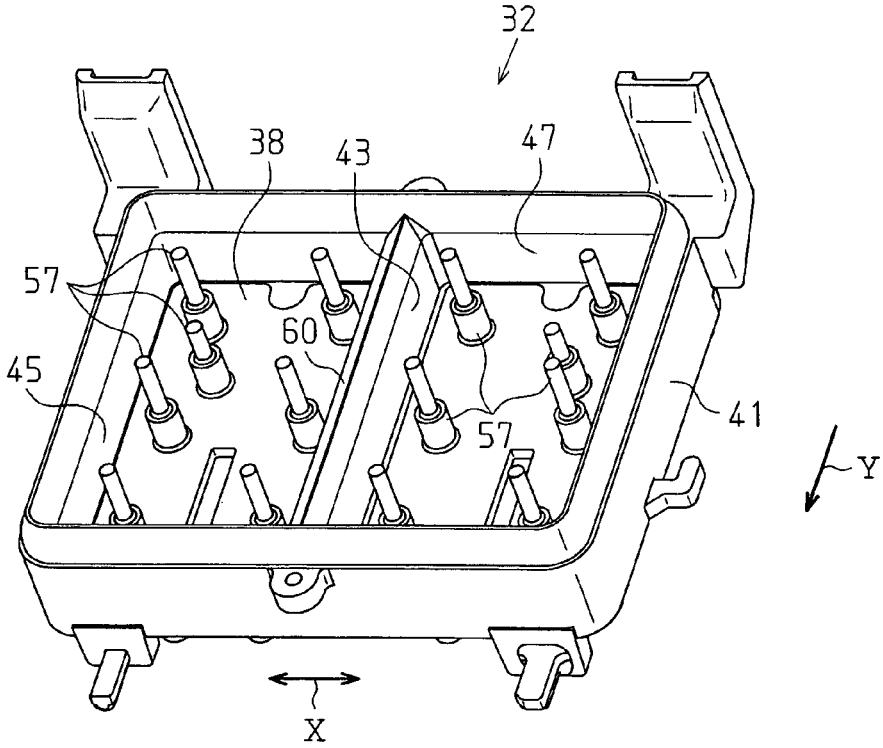
FIG. 17 is a perspective view of a cap according to a second modification of the present invention.

As shown in FIG. 17, the step part 60 may be formed along the entire length of the partition-wall elastic part 43*b*. In this case, no stress is generated between the partition wall 43 and the nozzle surface 20*a* when the outer wall 41 is pressed against the nozzle surface 20*a*. The outer-wall elastic part 41*b* reliably comes in close contact with the nozzle surface 20*a*.

Figure 18:
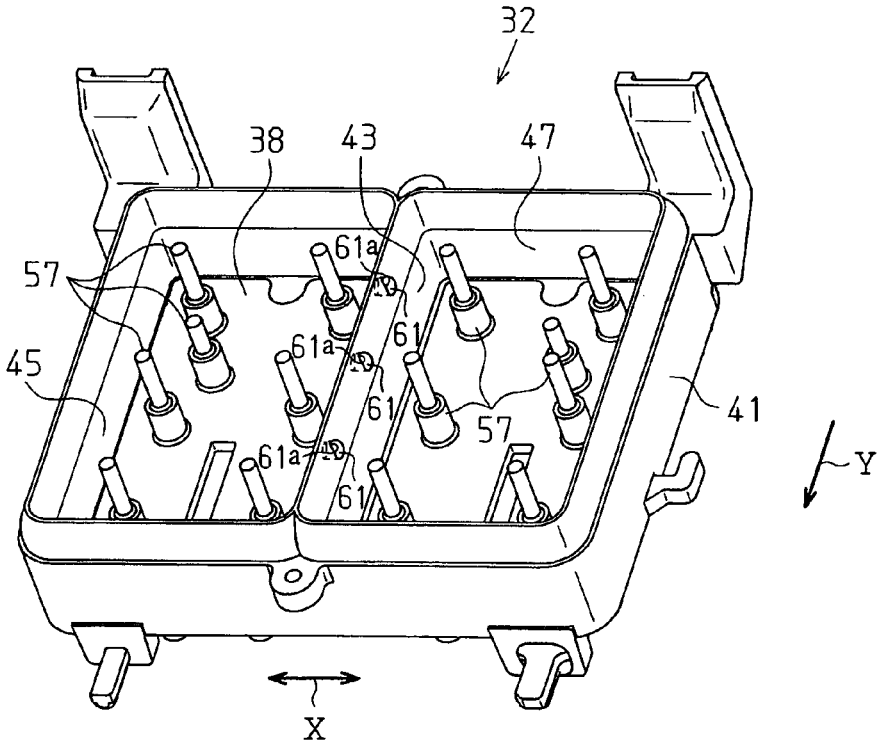
FIG. 18 is a perspective view of a cap according to a third modification of the present invention.

The connection path 61 may not be defined by the step part 60 and the nozzle surface 20*a*. For example, instead of the connection path 61, a through-hole 61*a* may be formed in the partition wall 43 to connect the first partitioned chamber S1 and the second partitioned chamber S2 as shown in FIG. 18.

In the second embodiment, the step part 60 (the upper edge 60*a*) is formed in the partition-wall elastic part 43*b*. The present invention should not be limited to such a structure. The step part 60 may be formed in the partition-wall resin part 43*a*.

In the second embodiment, the first and second partitioned chambers S1 and S2 are aspirated by the independent aspiration pumps 36*a* and 36*b*, respectively. The first and second partitioned chambers S1 and S2 may be aspirated by the integral-type aspiration pump 36 as in the first embodiment.

In the second embodiment, the aspiration tubes 33 and 34 are arranged to deliver fluids to the common set of waste liquid absorbing members 31. However, two sets of waste liquid absorbing members 31 respectively corresponding to the aspiration tubes 33 and 34 may be arranged as spaced from each other in the waste liquid tank 25. The aspiration tubes 33 and 34 respectively deliver fluids to the two sets of waste liquid absorbing members 31 via separate routes. Thus, color ink and reactive ink do not react and do not coagulate in the waste liquid absorbing members 31. This reliably prevents the aspiration ability of the cleaning mechanism 27 from being degraded.

The first and second case units 45 and 47 of the cap 32 correspond to color ink and reactive ink, respectively. However, the first and second case units 45 and 47 may correspond to other kinds of ink. For example, the first case unit 45 may correspond to pigment ink, and the second case unit 57 may correspond to dye ink.

The liquid ejecting apparatus of the present invention should not be limited to the printer 11 for ejecting ink (and printing apparatuses such as a facsimile and a copier), but may be embodied as liquid ejecting apparatuses for ejecting other liquids. For example, the liquid ejecting apparatus of the present invention may be an apparatus for ejecting such liquids as an electrode material and a color material for use in an LCD (liquid crystal display), an EL (electroluminescence) display, or a surface emitting display. Also, the liquid ejecting apparatus of the present invention may be an apparatus for ejecting living organisms for use in manufacturing bio tips, or may be a sample ejecting apparatus, such as a precision pipette.

The present examples and embodiments are to be considered as illustrative and not restrictive, and the invention is not to be limited to the details given herein, but may be modified within the scope and equivalence of the appended claims.

What is claimed is:

1. A liquid ejecting apparatus for ejecting a liquid toward a target, the liquid ejecting apparatus comprising:

a liquid ejecting head including a nozzle surface that has a plurality of nozzles for ejecting the liquid;

a cap including an outer wall that defines an opening, the opening being closed by the nozzle surface, wherein the outer wall comes into contact with the nozzle surface and the plurality of nozzles are covered by the cap when the nozzle surface closes the opening;

an aspiration mechanism, connected to the cap, for aspirating fluid in an inner space of the cap and draining the fluid from the inner space of the cap, wherein the cap includes a partition wall that comes into contact with the nozzle surface and defines a plurality of chambers together with the nozzle surface and the outer wall when the nozzle surface closes the opening, and wherein the cap includes a first contact part that is arranged in the outer wall and that has a first thickness and a second contact part that is arranged in the partition wall and that has a second thickness, the second thickness being less than the first thickness.

2. A printer apparatus for ejecting a liquid toward a print surface, the printer apparatus comprising:

a linearly movable printer head that stores the liquid, wherein the printer head includes a nozzle surface that has a plurality of nozzles for ejecting droplets of the liquid toward the print surface; and a cleaning mechanism for cleaning the plurality of nozzles when the printer head is placed at a home position, wherein the cleaning mechanism includes:

a cap for covering the plurality of nozzles when the printer head is at the home position; and an aspiration mechanism, connected to the cap, for depressurizing an inner space of the cap and draining the fluid from the inner space of the cap when the cap covers the plurality of nozzles, wherein the cap includes an outer wall and an inner wall that define a plurality of chambers in the cap, wherein the outer wall has a first contact part that comes into contact with the nozzle surface, the inner wall has a second contact part that comes into contact with the nozzle surface, and the second contact part is more easily deformable than the first contact part.

3. The printer apparatus according to claim 2, wherein the second contact part is thinner than the first contact part.

* * * * *